US006511359B1

(12) United States Patent
Lui

(10) Patent No.: US 6,511,359 B1
(45) Date of Patent: Jan. 28, 2003

(54) BOBBLING HEAD TOY FIGURINE WITH PHOTO RECEIVING CHAMBER

(76) Inventor: Hoe King Lui, Room 15A, Shinyam Commerical Building, #163 Johnston Road, Hong Kong (HK)

( * ) Notice: Subject to any disclaimer, the term of this patent is extended or adjusted under 35 U.S.C. 154(b) by 0 days.

(21) Appl. No.: 10/218,373

(22) Filed: Aug. 13, 2002

(51) Int. Cl.[7] ..... A63H 3/12

(52) U.S. Cl. ..... 446/321; 446/100; 446/391; 40/411; 40/766

(58) Field of Search ..... 446/97, 99, 100, 446/298, 300, 321, 330, 337, 338, 339, 376, 380, 379, 384, 391, 486; 40/411, 424, 766, 765; 434/236, 237, 393

(56) References Cited

U.S. PATENT DOCUMENTS

| | | | | | |
|---|---|---|---|---|---|
| 2,199,049 | A | * | 4/1940 | Greenberg | 446/100 |
| 2,484,343 | A | | 10/1949 | Hawes | |
| 2,760,303 | A | * | 8/1956 | Del Mas | 446/97 |
| D226,772 | S | | 4/1973 | Ehrenreich | |
| 3,863,386 | A | * | 2/1975 | Kinberg | 446/183 |
| 4,020,586 | A | | 5/1977 | Benner | |
| 5,141,466 | A | * | 8/1992 | Catizone | 446/391 |
| 5,403,224 | A | | 4/1995 | Gintling | |
| 5,498,189 | A | * | 3/1996 | Townsend | 446/100 |
| 5,803,788 | A | * | 9/1998 | Penberthy et al. | 446/391 |
| 5,947,791 | A | | 9/1999 | Taylor | |
| 6,183,338 | B1 | * | 2/2001 | Mallette | 446/337 |

* cited by examiner

*Primary Examiner*—Jacob K. Ackun
*Assistant Examiner*—Bena B. Miller
(74) *Attorney, Agent, or Firm*—Jack C. Munro

(57) ABSTRACT

A toy figurine that has a head that randomly bobbles relative to the body. The head includes a photo receiving compartment with an entry slot connecting with the photo receiving compartment. A photograph is to be inserted through the entry slot into the photo receiving compartment. A headgear is mounted on the head with the headgear covering the entry slot. The headgear is magnetically attached to the head.

5 Claims, 2 Drawing Sheets

BOBBLING HEAD TOY FIGURINE WITH PHOTO RECEIVING CHAMBER

BACKGROUND OF THE INVENTION

1. Field of the Invention

The subject matter of this invention relates to toy figurines and more particularly to a toy figurine which includes a bobbling head with a photo receiving compartment included within the bobbling head with a photographic likeness of a person to be located within the photo receiving compartment.

2. Description of the Related Art

Toy figurines have long appealed to children and adults. Toy figurines, or dolls, are commonly used by female children to play with. Also, toy figurines are used for therapy. One type of therapy is that when children are removed from a known surrounding to an unknown surrounding that the fact that the child has available a doll to hold onto provides comfort for the child. Also, in situations where children are removed from abusive surroundings, possibly a doll can provide comfort to that child.

A relatively new type of toy figurine is a figurine which mounts the head of the figurine on the body in a manner so that the head can move. It is common to connect the head by means of a spring relative to the body. This will permit the head to move randomly a limited amount in a multitude of directions. This type of movement is frequently termed bobbling.

It is also known to construct a doll or toy figurine that contains a photograph representation of a human being within the face of the toy figurine. Thus, a particular person may find pleasure in having a representation of himself or herself, girlfriend or boyfriend, another sibling or an adult, such as father, mother, aunt or uncle mounted in conjunction with the toy figurine. Previously, the dolls or toy figurines that have been constructed to include a photographic representation are not constructed with a high degree of quality. For example, the structure that is used to mount the photographic representation in conjunction with the doll is readily observable and it detracts from the overall appearance of the toy figurine. Additionally, if the toy figurine is constructed to include some kind of headgear, it is easy for the headgear to become disassociated from the head of the toy figurine which frequently results in the headgear becoming misplaced relative to the toy figurine.

Additionally, toy figurines of the prior art have been constructed in one basic configuration. There has not been known to construct a bobbling head photographic representation toy figurine that is available in numerous configurations. Typical configurations would be that of a hockey player, a basketball player, a golfer, a baseball player, to name a few.

SUMMARY OF THE INVENTION

The basic embodiment of the present invention is a toy figurine which has a specific selected appearance which has a body representing a body of a human, and at the upper end of the body is formed a neck section. A spring is attached to this neck section. A head is attached to the spring with the head being capable of moving by bobbling on the body. The head has a photo receiving compartment with there being an entry slot formed within the head connecting with the compartment. A photograph is to be inserted through the entry slot and contained within the photo receiving compartment. An enlarged observing opening is formed within the head that connects with the photo receiving compartment and is adapted to permit one to readily observe the photograph mounted within the photo receiving compartment. A magnet is mounted on the head. The head and the magnet are to be locatable within an internal chamber of a headgear. A second magnet is mounted on the headgear. The two magnets magnetically attract each other which functions to secure the headgear on the head in a fixed position.

A further embodiment of the present invention is where the basic embodiment is modified by the spring being defined as a coil spring.

A further embodiment of the present invention is where the basic embodiment is modified by the head including a recess with a first magnet being mounted within this recess.

A further embodiment of the present invention is where the just previous embodiment is modified by the headgear having formed a protrusion within the internal chamber with the second magnet being mounted on the protrusion, and when the headgear is mounted on the head, the protrusion is mounted within the recess with the two magnets abutting each other.

A further embodiment of the present invention is where the basic embodiment is modified by the headgear being of a sufficient size to cover the entry slot into the photo receiving compartment when the headgear is mounted in conjunction with the head.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
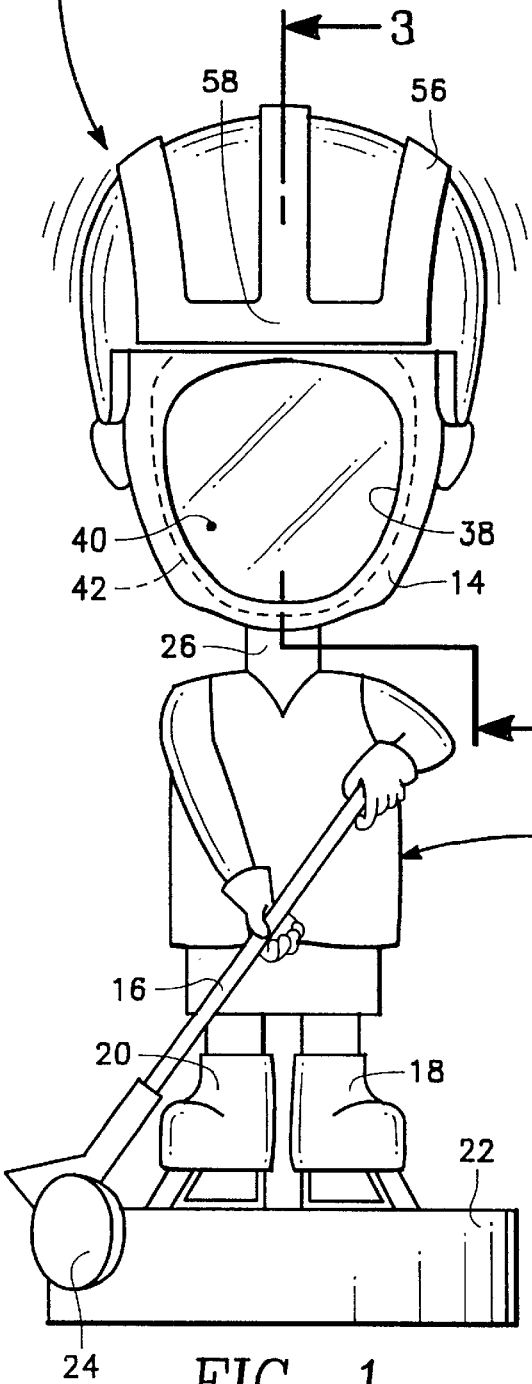
FIG. 1 is a front view of the toy figurine of the present invention which would be the typical usage position for the toy figurine.
Figure 2:
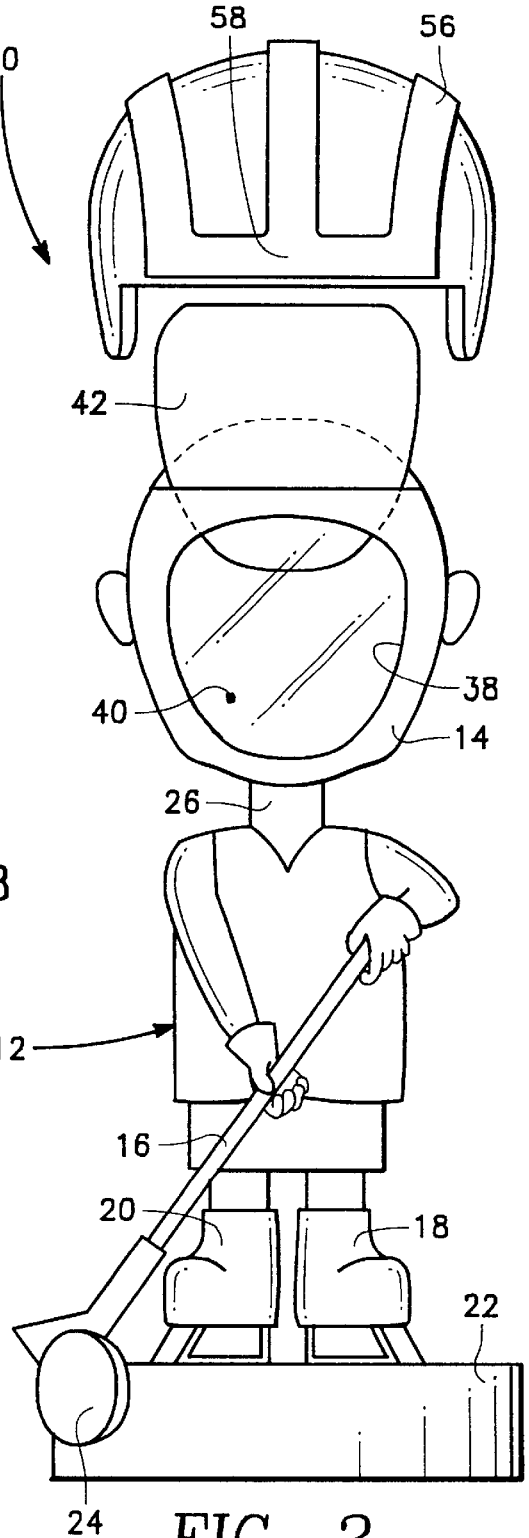
FIG. 2 is a view similar to FIG. 1 but showing a photograph partially removed from the photo receiving compartment of the toy figurine and the headgear being disengaged from the head.
Figure 3:
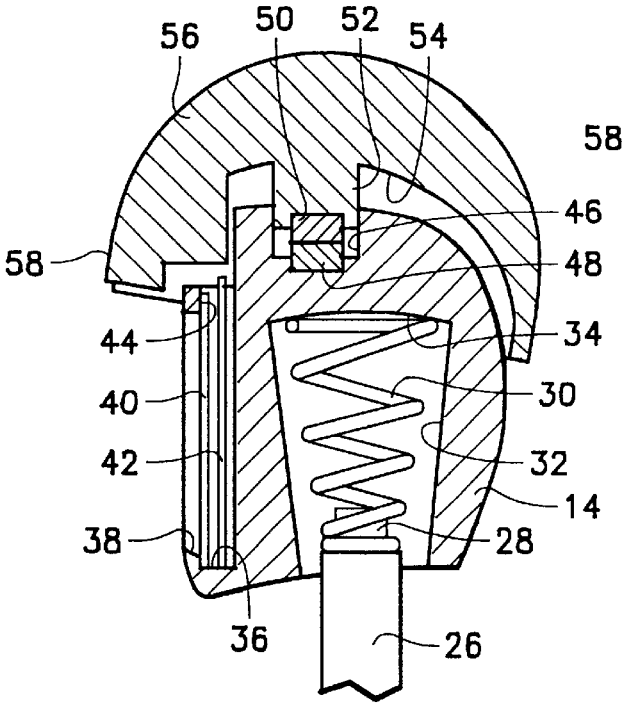
FIG. 3 is a cross-sectional view through the head and headgear of the toy figurine of the present invention taken along line 3—3 of FIG. 1 showing the headgear mounted on the head.
Figure 4:
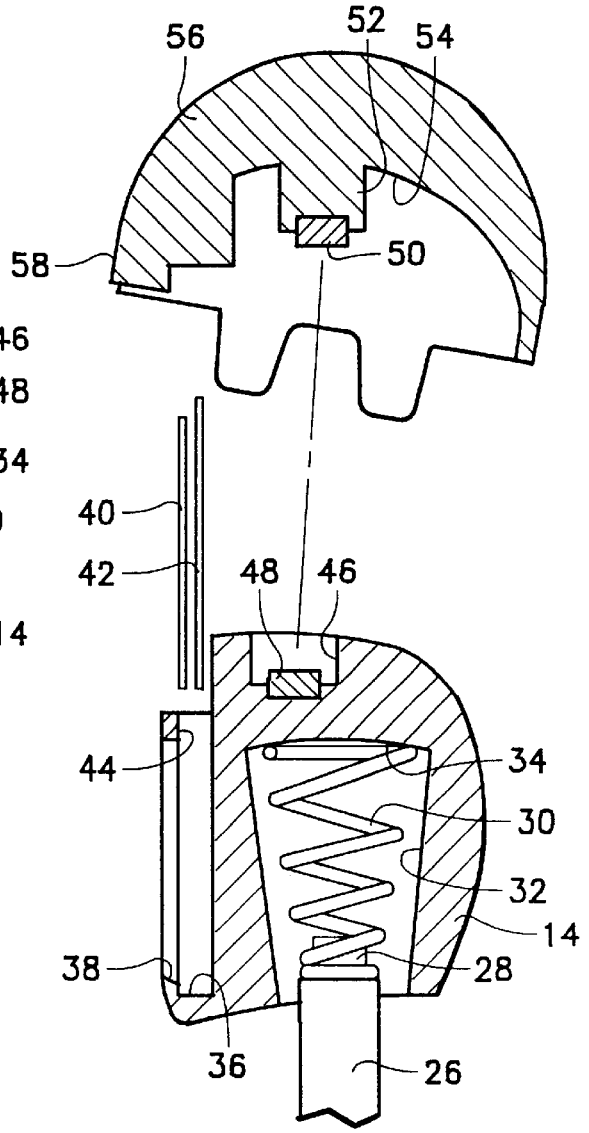
FIG. 4 is a view similar to FIG. 3 but with a photograph shown removed from the photo receiving compartment and the headgear being shown spaced from the head.

Referring particularly to the drawings, there is shown in FIGS. 1 and 2 the toy figurine 10 of the present invention. The toy figuring 10 has a body 12 and a head 14. The body 12 is to be formed into some special appearance. The appearance shown in FIGS. 1 and 2 is that of a hockey player with the body 12 including a hockey stick 16 which is fixed to the body 12. The body 12 includes feet 18 and 20 which are mounted on a mounting base 22. A representation of a hockey puck 24 is mounted on the base 22. It is to be understood that the body 12 could be formed into numerous different selected appearances with a hockey player being only one of many of these appearances. All of the toy figurines will be constructed in a similar manner.

Mounted on the body 12 is a neck section 26 which basically comprises a cylindrically shaped upstanding member. The neck section 26 terminates at its upper end in a plug 28 which is of a smaller diameter than the neck section 26. Mounted about the plug 28 in a tight fitting manner is one end of a coil spring 30. The entire coil spring 30 is located within enlarged recess 32 formed within the head 14. The upper end of the coil spring 30 is fixedly secured to inner wall 34 of the enlarged recess 32. The result is the head 14 can move in a randomly bobbling manner relative to the body 12. This random movement of the head 14 produces a desirable appearance that is attractive to not only children but to some adults.

Formed within the head 14 is a photo receiving compartment 36. The photo receiving compartment 36 basically takes the form of a narrow chamber that can be readily observed by means of an enlarge observing opening 38 which is formed within the head 14. The photo receiving compartment 36 is designed to receive a transparent plastic protective cover 40 which is located directly adjacent the opening 38. Located interiorly of the cover 40 is a photograph 42. The photograph 42 generally will be cut from the sheet material of an existing photograph and will generally be the representation of the face of a human. The photograph 42 is basically shaped to conform to the size of the photo receiving compartment 36. The photograph 42 is to be slid through entry opening 44 to within the photo receiving compartment 36.

Formed within the head 14 is a recess 46. Fixedly mounted within the recess 46 is a first magnet 48. The first magnet 48 is to attract and forcibly connect to a second magnet 50. The second magnet 50 is mounted on the outer end of a protrusion 52. The protrusion 52 is located within an internal chamber 54 of a headgear 56. Typically, the headgear 56 will comprise a hat, hair or a helmet, which is shown in the drawings. The protrusion 52 connects in a close conforming manner with the recess 46. It is to be noted that the size of the headgear 56 is such that the front edge 58 of the headgear 56 will cover the entry opening 42 when the headgear 56 is mounted in conjunction with the head 14. This is a desirable arrangement so that when the headgear 56 is mounted on the head 14 that the entry opening 44 is hidden from view. The entry opening 44 and the top edge of the photograph 42 do not really make for an attractive appearance. Therefore, it is better that the headgear 56 be selected to be of a size in order to cover this entry opening 44.

What is claimed is:

1. A toy figurine having a specific selected appearance comprising:

a body terminating in an upper end in a neck section;

a spring attached to said neck section;

a head attached to said spring, said head being capable of moving by bobbling on said body, said head having a photo receiving compartment, said photo receiving compartment having an entry slot through which a photograph is to be inserted into and located within said photo receiving compartment, a first magnet mounted on said head; and a headgear having an internal chamber, a second magnet mounted on said headgear and located within said internal chamber, said second magnet to connect with said first magnet to fixedly removably secure said headgear to said head with said head located within said internal chamber.

2. The toy figurine as defined in claim 1 wherein:

said spring comprising a coil spring.

3. The toy figurine as defined in claim 1 wherein:

said head including a recess, said first magnet being mounted within said recess.

4. The toy figurine as defined in claim 3 wherein:

said headgear including a protrusion, said protrusion being located within said internal chamber, said protrusion having said second magnet being mounted thereon, said protrusion to connect with said recess when said headgear is mounted on said head.

5. The toy figurine as defined in claim 1 wherein:

said headgear to cover up said entry slot when said headgear connects with said head.

* * * * *